US006588883B2

(12) United States Patent
Nakatani et al.

(10) Patent No.: US 6,588,883 B2
(45) Date of Patent: Jul. 8, 2003

(54) LIQUID INJECTOR, METHOD OF MANUFACTURING THE INJECTOR, AND INK-JET SPRAY USING THE INJECTOR

(75) Inventors: Masaya Nakatani, Takarazuka (JP); Katsumasa Miki, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 12 days.

(21) Appl. No.: 10/046,531

(22) Filed: Jan. 14, 2002

(65) Prior Publication Data

US 2002/0093549 A1 Jul. 18, 2002

(30) Foreign Application Priority Data

Jan. 15, 2001 (JP) ..... 2001-006021

(51) Int. Cl.[7] ..... B41J 2/04

(52) U.S. Cl. ..... 347/54

(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 6,527,373 * 3/2003 Delametter et al.

FOREIGN PATENT DOCUMENTS

WO WO99/65689 12/1999

* cited by examiner

*Primary Examiner*—Raquel Yvette Gordon
(74) *Attorney, Agent, or Firm*—RatnerPrestia

(57) ABSTRACT

A liquid injector having a liquid eject outlet side reduced in size is provided. In a head block of the liquid injector, a pressurizing chamber is linearly aligned with a liquid eject outlet and liquid feed inlet.

28 Claims, 8 Drawing Sheets

LIQUID INJECTOR, METHOD OF MANUFACTURING THE INJECTOR, AND INK-JET SPRAY USING THE INJECTOR

FIELD OF THE INVENTION

The present invention relates to a small-sized liquid injector in a printing head in an ink-jet printer for delivering liquid such as ink, an ink-jet spray employing the liquid injector, and a method of manufacturing the liquid injector.

BACKGROUND OF THE INVENTION

A conventional liquid injector includes a pressurizing-chamber-forming layer having pressurizing chambers provided therein, a pressurizing element on one side of the pressurizing-chamber-forming layer, and a substrate on the other side of the pressurizing-chamber-forming layer. Each the pressurizing chamber has a first opening provided directly on the substrate, a second opening provided directly on the pressurizing element, a liquid eject outlet which is opening to the outside, and a liquid feed inlet provided therein for feeding liquid into the pressurizing chamber. A pressure, upon being applied from the second opening by the pressurizing element, can be transmitted into the pressurizing chamber and eject the liquid from the liquid eject outlet to the outside of the pressurizing chamber.

In the conventional liquid injector, the pressurizing chamber, liquid eject outlet, and liquid feed inlet are formed in 3-dimensional shape with components made of ceramic material or stainless steel bonded one another. Since including the components element together, the liquid injector has a liquid eject outlet side thereof increased in area and can thus be hardly reduced in overall size.

SUMMARY OF THE INVENTION

A liquid injector which has a liquid eject outlet side thereof reduced in area is provided, thus contributing to a small-dimension ink-jet printer. The liquid injector includes: a head block including a first pressurizing-chamber-forming layer having a first pressurizing chamber formed therein for being filled with liquid, a first liquid eject outlet and a first liquid feed inlet through which the liquid is passed from the first pressurizing chamber; and a first actuator on the first pressurizing-chamber-forming layer for expanding and contracting an internal volume of the first pressurizing chamber. The first pressurizing chamber, the first liquid eject outlet, and the first liquid feed inlet are linearly aligned.

DETAILED DESCRIPTION OF THE PREFERRED EMBODIMENTS

Embodiment 1

Figure 1:
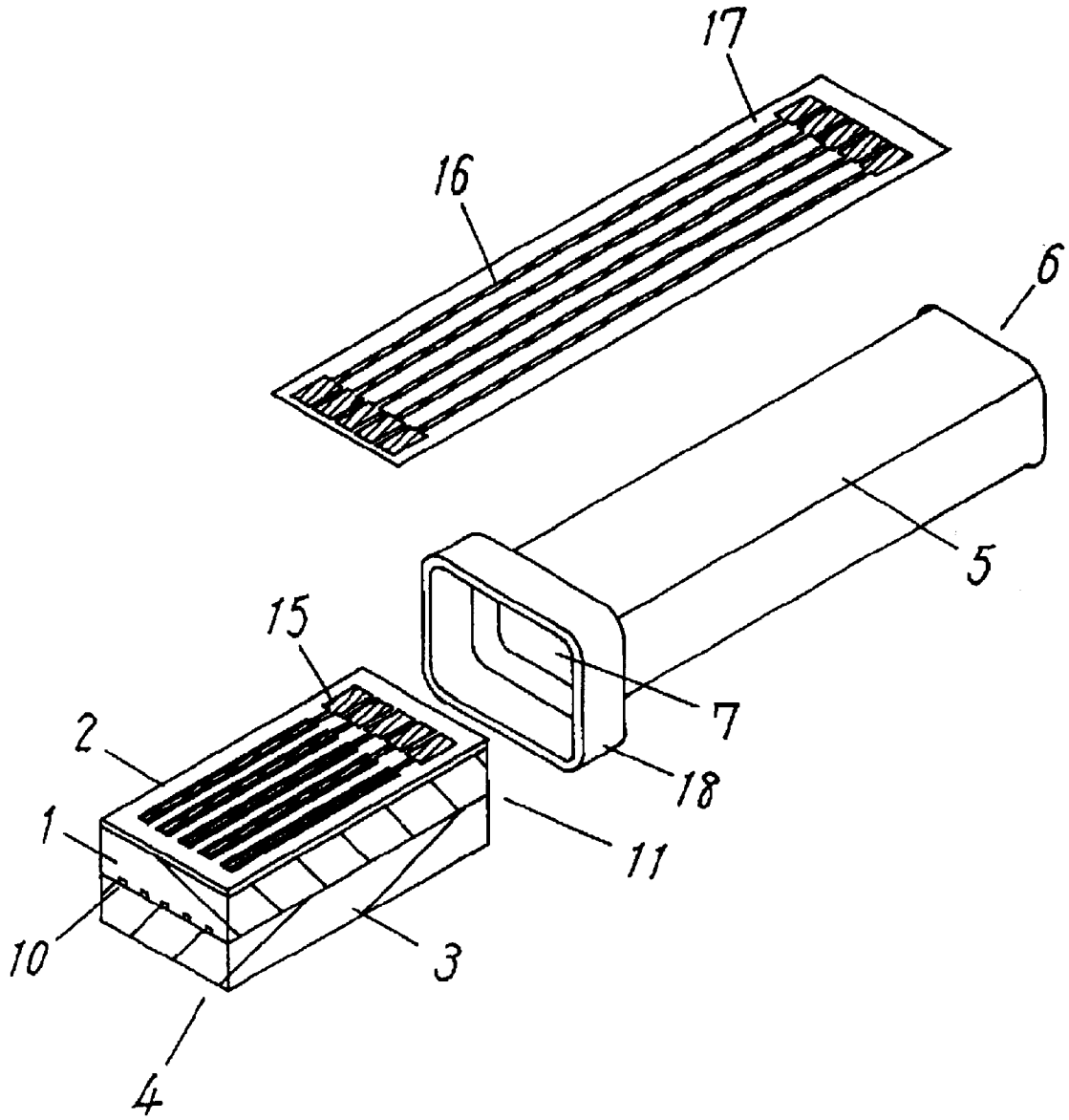
FIG. 1 is an exploded perspective view of a liquid injector according to Embodiment 1 of the present invention.

FIG. 1 is an exploded perspective view of a liquid injector according to Embodiment 1 of the present invention. A head block 4 includes a pressurizing-chamber-forming layer 1 made of silicon single-crystal material, a pressurizing element 2 mounted to one side of the pressurizing-chamber-forming layer 1, and a substrate 3 made of glass mounted to the other side of the pressurizing-chamber-forming layer 1. The head block 4 is bonded at its rear end to a liquid feed reservoir 5 for feeding liquid. First lead-out electrodes 15 are provided on the head block 4 and connected to respective second lead-out electrodes 16 mounted on a flexible substrate 17. The liquid feed reservoir 5 has a liquid supply inlet 6 at the rear end, a liquid passage 7 communicated to the liquid supply inlet 6, and an opening at the other end thereof.

Figure 2:
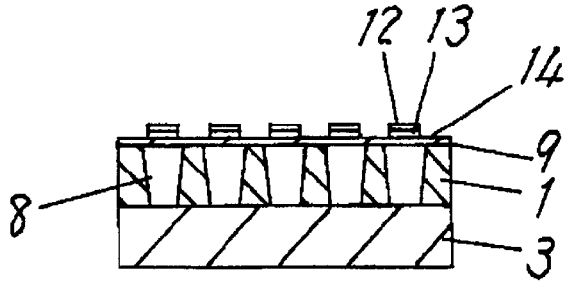
FIG. 2 is a cross sectional view of pressurizing chambers as a primary part in the liquid injector according to Embodiment 1.

FIG. 2 is a cross sectional view taken vertically to a longitudinal direction of pressurizing chambers 8, a primary part in the liquid injector. The pressurizing chambers 8 fully extend from one end to the other end of the pressurizing-chamber-forming layer 1. The forming layer 1 is bonded at one side to the pressurizing element 2 with by an adhesive layer 9 and bonded at the other end directly to the glass substrate 3 without adhesive. This allows the pressurizing chambers 8 to have both, upper and lower, opening sides are isolated from the outside. As a result, the assembly of them can 4 can be fabricated to any desired, intricate three-dimensional shape easily.

As shown in FIG. 1, each pressurizing chamber 8 has a liquid eject outlet 10 and a liquid feed inlet 11 (not shown) provided at both ends thereof The pressurizing chamber 8 is communicated to the liquid feed passage 7 through the liquid feed inlet 11. This allows the liquid such as printing ink to flow from the liquid feed inlet 6 to the liquid feed passage 7, the liquid feed inlet 11, the pressurizing chamber 8, and the liquid eject output 10. The liquid feed passage, since being constantly filled with the liquid or ink, can readily deliver the liquid to each pressurizing chamber.

The pressurizing element 2 incorporates a layer structure including second electrode strips 12, piezoelectric strips 13 made of lead titanate/zirconate, and a pressing-force-generating layer 14 made of conductive material such as chrome or titanium from above in this order. The lead titanate/zirconate strip, since expanding or contracting vertically in an electric field along its thickness direction, functions as an actuator for increasing the pressure in the pressurizing chamber 8. The pressurizing-force-generating layer 14 in this embodiment, upon being electrically conductive, may function as the first electrode layer. If the pressing-force-generating layer 14 is not conductive, the first electrode layer may be provided between the piezoelectric strip 13 and the pressing-force-generating layer 14. The pressurizing element 2 is bonded to the pressurizing-chamber-forming layer 1 with the adhesive layer 9 on the side to the pressurizing-chamber-forming layer 1 of the pressing-force-generating layer 14. The second electrode strips 12 and the piezoelectric strips 13 are provided for the pressurizing chambers 8 provided below. Each pressurizing chamber 8 has the liquid eject output 10 and the liquid feed inlet 11 provided linearly at both ends thereof.

In this liquid injector, when the second lead-out electrodes 16 connected to the respective second electrode strips 12 on the respective pressurizing chambers 8 are provided with a voltage, the pressurizing element 2 pressurizes the pressurizing chambers 8. As a result, the ink is pressed and moved to the liquid eject outlet 10 of each pressurizing chamber 8. Upon being ejected, droplets of the ink are patterned on a recording medium such as a sheet of paper for printing. Since the liquid feed inlet 11 and the liquid eject outlet 10 of the pressurizing chamber 8 are linearly aligned to each other, their installation area on the head block is reduced even having the plural pressurizing chambers 8. This allows the liquid feed reservoir 5 to be connected linearly to the liquid feed inlets 11, thus having a linear structure of the liquid injector. Accordingly, the liquid injector of the embodiment can has a reduced overall size. The liquid injector having such a linear construction may preferably be applied to a long, narrow product such as a pen, thus providing a portable ink-jet pen.

The head block 4 includes the liquid eject outlet 10, the pressurizing chamber 8, and the liquid feed inlet 11 which are linearly aligned. This allows the pressurizing-chamber-forming layer 1 to have a simple structure thus contributing to efficient mass production of the liquid injector. If the pressurizing-chamber-forming layer 1 is made of a silicon single-crystal sheet, the pressurizing chambers 8 can be formed easily by etching. Further, the pressurizing-chamber-forming layer 1 of a silicon single-crystal sheet can be mirror-like-finished and easily bonded at its mirror-like-finished side with a corresponding mirror-like-finished side of the glass substrate 3 to be unified. Since the cross section of the liquid passage 7 of the liquid feed reservoir 5 is greater than that of the liquid feed inlets 11 of the pressurizing-chamber-forming layer 1, the liquid is distributed to the liquid feed inlets 11 uniformly. Moreover, the head block and the liquid feed reservoir can easily be bonded to each other without misalignment. When the liquid feed reservoir 5 is made of plastic material at its opening 18 and arranged integral with the flexible substrate 17, the reservoir 5 can be bonded to the head block 4 at once by thermal bonding. Furthermore, when the liquid feed reservoir 5 is flexible, the liquid injector can apply the liquid to any curved object, e.g. an inner wall of a curved conduit.

A method of manufacturing the liquid injector will now be described.

FIG. 3 to FIG. 8 are cross sectional views illustrating processes of manufacturing the liquid injector according to Embodiment 1.

Figure 3:
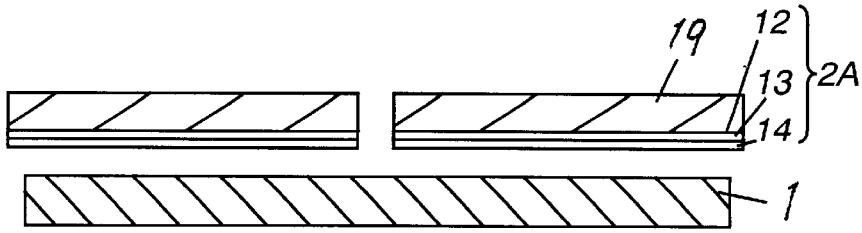
FIG. 3 is a cross sectional view illustrating a process of manufacturing the liquid injector according to Embodiment 1.

As shown in FIG. 3, a pressurizing element base 2A is formed on a pressurizing-element-forming layer 19 made of magnesium oxide single-crystal material. The pressurizing element base 2A is converted to the pressurizing element 2 by patterning. Similarly, a second electrode strip layer 12A, a piezoelectric strip layer 13A, and a pressing force generating layer 14 are formed.

Figure 4:
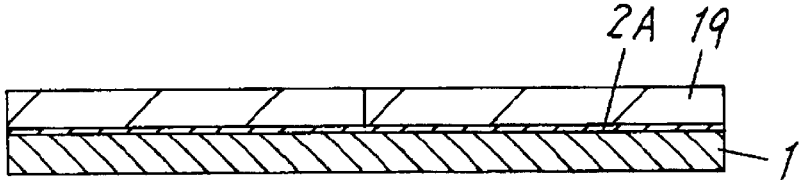
FIG. 4 is a cross sectional view illustrating a process of manufacturing the liquid injector according to Embodiment 1.

Then, as shown in FIG. 4, plural pressurizing-element-forming layers 19 having the pressurizing element bases 2A provided thereon are bonded at its side to pressurizing element base 2A with an adhesive, which is softer than the silicon single-crystal material, to the pressurizing chamber-forming layer 1 of the silicon single-crystal material as shown in FIG. 4.

Figure 5:
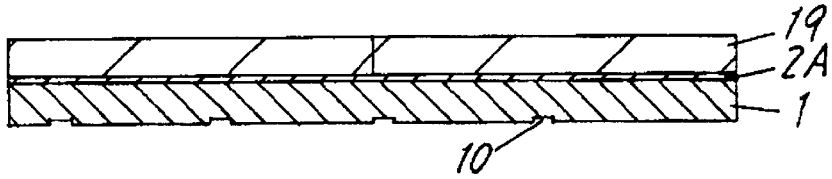
FIG. 5 is a cross sectional view illustrating a process of manufacturing the liquid injector according to Embodiment 1.
Figure 6:
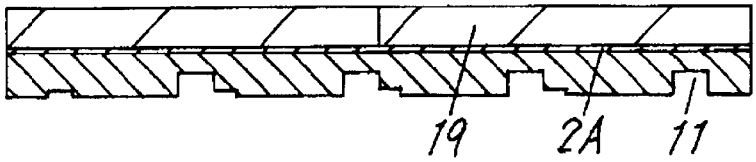
FIG. 6 is a cross sectional view illustrating a process of manufacturing the liquid injector according to Embodiment 1.

Then, other side of the side to the pressurizing element base 2A of the pressurizing-chamber-forming layer 1 is dry-etched with dry-etching gas containing fluorine, e.g. sulfur hexafluoride, to form the liquid eject outlets 10 and the liquid feed inlets 11, as shown in FIG. 5 and FIG. 6. The pressurizing-chamber-forming layer 1 is etched at two steps to modify the depth at the liquid eject outlets 10 and the liquid feed inlets 11 shown in FIGS. 5 and 6, however, the layer 1 may be subjected to a single etching process if the depth is not modified.

Figure 7:
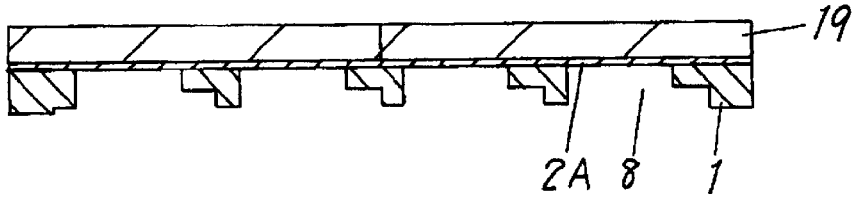
FIG. 7 is a cross sectional view illustrating a process of manufacturing the liquid injector according to Embodiment 1.

Then, as shown in FIG. 7, the pressurizing-chamber-forming layer 1 is again dry-etched with sulfur hexafluoride to shape the pressurizing chambers 8 until the layer 1 is perforated. For forming the pressurizing chambers 8, the pressurizing-chamber-forming layer 1 is etched from the other side than the side bonded to the pressurizing element bases 2A with the adhesive. The etching of the pressurizing chamber forming layer 1 is terminated upon reaching the adhesive layer. This allows the pressurizing chambers 8 to be simply fabricated by etching from one side to the other side of the pressurizing-chamber-forming layer 1. The pressurizing element bases 2A are unified with the pressurizing-element-forming layers 19, and then, bonded to one side of the pressurizing chamber forming layer 1 with the adhesive. Thereby, the pressurizing element bases 2A can first be developed on the pressurizing element forming layers 19 easily. Since the pressurizing element bases 2A with the pressurizing element forming layers 19 are then bonded by the adhesive to the pressurizing chamber forming layer 1, the liquid injector can be finished efficiently. 40 mm square or greater of a magnesium oxide single-crystal material which is commonly used as the pressurizing element forming layer can be hardly be formed. On the contrary, the silicon single-crystal material can be shaped to a greater size. The pressurizing chamber forming layer 1 of the silicon single-crystal material bonded with the pressurizing element forming layers can be processed. Therefore, more head block can be fabricated at once without difficulty. The head block, upon having the size equal to a fraction of the pressurizing-element-forming layer divided by an integer, can be fabricated efficiently.

Figure 8:
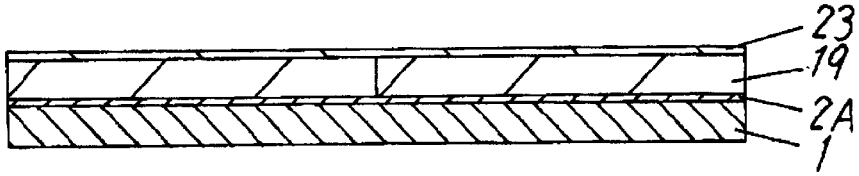
FIG. 8 is a cross sectional view illustrating a process of manufacturing the liquid injector according to Embodiment 1.

In another method of forming the pressurizing chambers 8, as shown in FIG. 8, a metal layer 23 consisting mainly of gold is developed on the other side than the side to the pressurizing element base 2A of the pressurizing-element-forming layer 19 before the pressurizing chamber forming layer 1 is dry-etched. This allows the pressurizing-element-forming layers 19 to be made of a magnesium oxide single-crystal material which can thus be removed easily. The pressurizing-element-forming layer 19, upon being made of magnesium oxide single-crystal material, does not have a so high thermal conductivity. This may cause accumulation of heat in the magnesium oxide single-crystal material during the dry-etching process, and thus making the process unstable. As a result, a rate of the etching process is hardly consistent. Since the pressurizing-element-forming layer 19 of the magnetic oxide single-crystal material is coated with the metal or heat-radiating layer which has a thermal conductivity than magnesium oxide at the other side than the side to the pressurizing element base 2A, the heat accumulation during the dry etching process can successfully be avoided. Accordingly, the etching rate may be consistent thus contributing to the manufacturing of the pressurizing chambers 8 appropriately.

Then, the pressurizing chamber forming layer 1, after being provided with the pressurizing chambers 8, is rinsed together with the pressurizing-element-forming layers 19 with rinsing agent of acid type. As described previously, the metal layer 23 consisting mainly of gold can prevent the magnesium oxide single-crystal material of the pressurizing-element-forming layers 19 from being removed by the acid type rinsing agent during the rinsing process.

Figure 9:
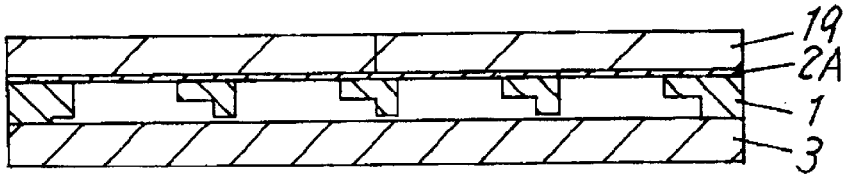
FIG. 9 is a cross sectional view illustrating a process of manufacturing the liquid injector according to Embodiment 1.

After being rinsed with the acid type rinsing agent, the pressurizing-chamber-forming layer 1 is bonded to the glass substrate 3 at the other side than the side to the pressurizing-element-forming layer 19 by direct bonding process, as shown in FIG. 9. The pressurizing-chamber-forming layer 1, since having been rinsed with the acid type rinsing agent, can directly be bonded to the glass substrate 3 easily. Further, the glass substrate 3 and the pressurizing-chamber-forming layer 1, upon being mirror-like-finished at the bonding side, can be bonded tightly to each other easily.

After the bonding, the metal layer 23 consisting mainly of gold (not shown in FIG. 9) is removed with neutral or like etching liquid such as iodine/potassium iodide solution.

Figure 10:
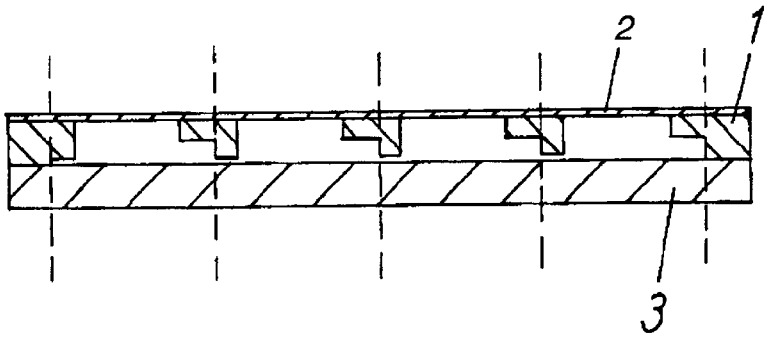
FIG. 10 is a cross sectional view illustrating a process of manufacturing the liquid injector according to Embodiment 1.

Then, the pressurizing-element-forming layers 19 of the magnesium oxide single-crystal material is removed with phosphate solution, as shown in FIG. 10, and a second electrode layer 9A and a piezoelectric layer 10A are patterned to form the second electrode strip 12 and the piezoelectric strip 13 over each pressurizing chamber 8, respectively.

Figure 11:
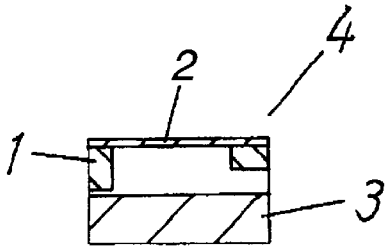
FIG. 11 is a cross sectional view illustrating a process of manufacturing the liquid injector according to Embodiment 1.

Then, the element is divided by dicing into the head blocks 4, as shown in FIG. 11. Since the neutral or like solution removes the heat radiating layer 23 consisting mainly of gold, the pressurizing-element-forming layers 19 of the magnesium oxide provided below the layers 23 is hardly corroded. The pressurizing-element-forming layers 19 remain intact and can thus be removed with the phosphate solution. The electrode layers provided below, since not being corroded with the phosphate solution, are properly patterned to form the pressurizing element 2. The head block 4, since being devided by dicing, has the liquid eject outlets 10 and liquid feed inlets 11 aligned along the line of the dicing and thus exposed evenly to the outside.

Figure 12:
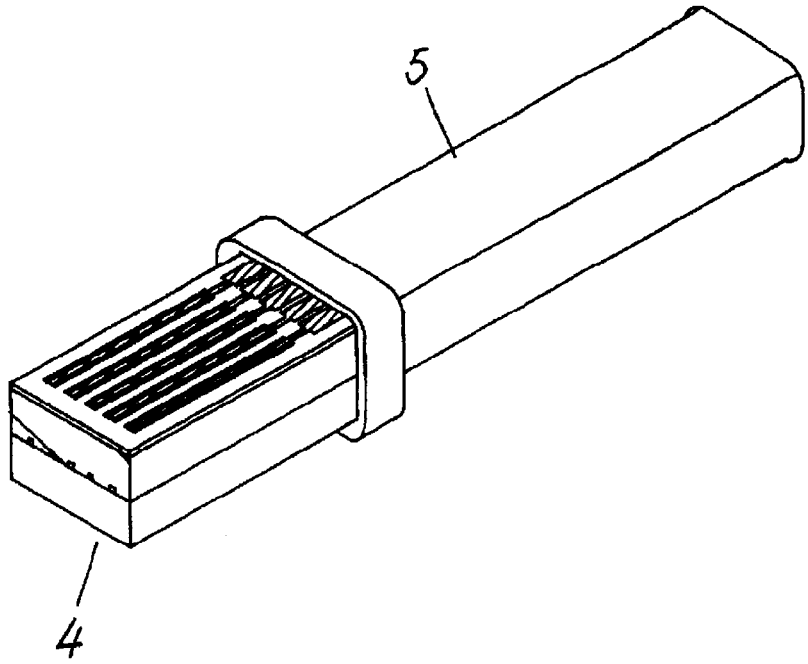
FIG. 12 is a perspective view illustrating a process of manufacturing the liquid injector according to Embodiment 1.

Then, the head block 4 is bonded to the liquid feed reservoir 5 to complete the liquid injector, as shown in FIG. 12. As shown in FIG. 1, the opening 18 of the liquid feed reservoir 5 is greater than the cross section of the head block 4 at the side to the liquid feed inlet 11. The liquid feed reservoir 5, upon being made of plastic material at the opening 18, can simply be inserted into and joined to the head block 4 by thermal bonding.

Figure 13:
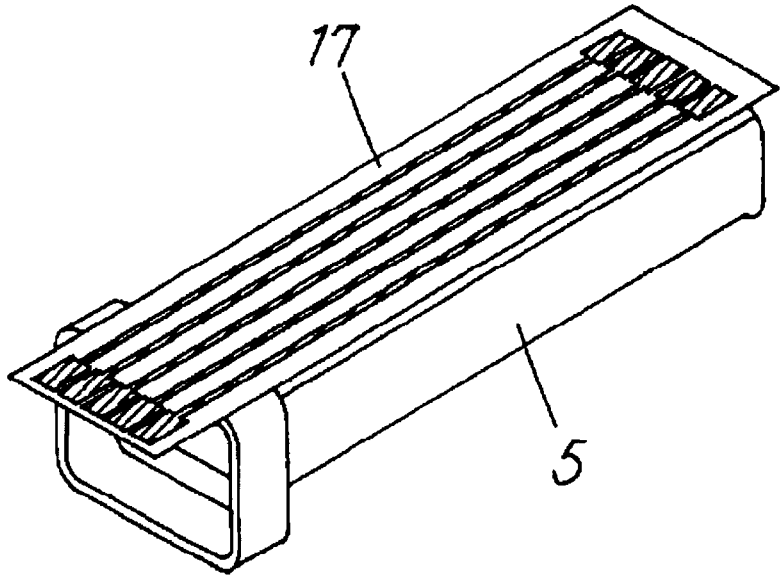
FIG. 13 is a perspective view illustrating a process of manufacturing the liquid injector according to Embodiment 1.
Figure 14:
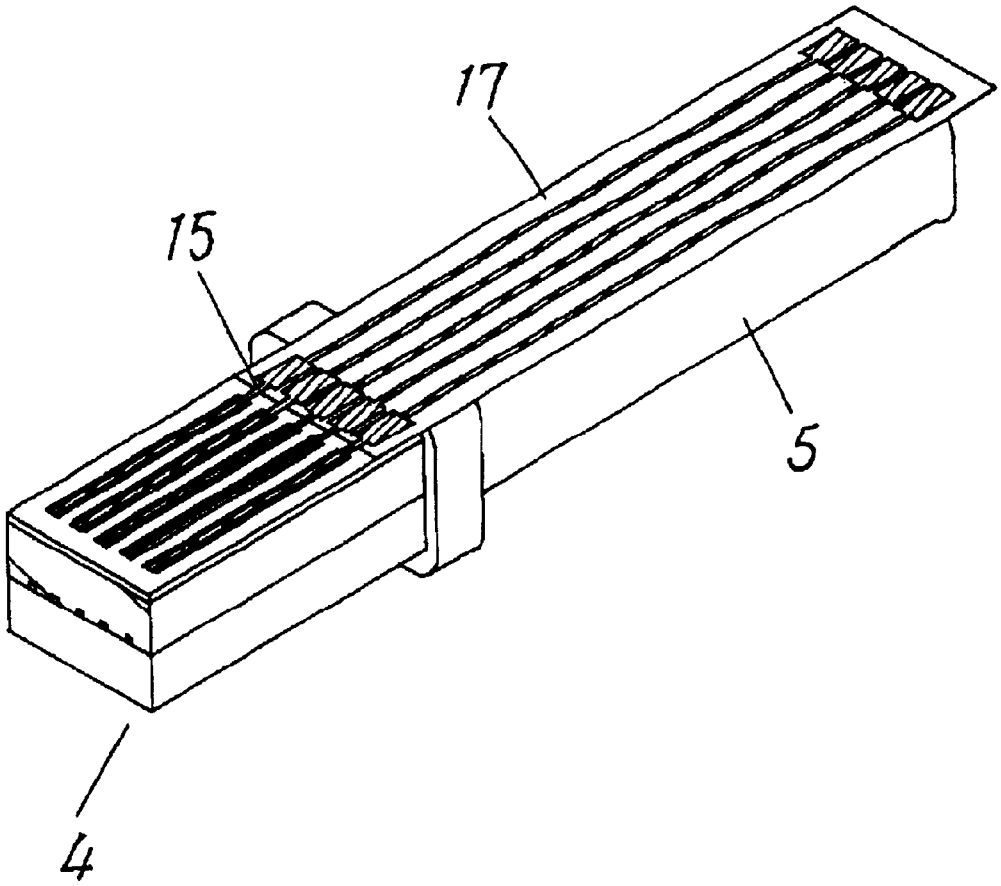
FIG. 14 is a perspective view illustrating a process of manufacturing the liquid injector according to Embodiment 1.

The flexible substrate 17 may be coupled to the liquid feed reservoir 5 in advance, as shown in FIG. 13. This allows the flexible substrate 17 to be connected to the first lead-out electrodes 15 of the head block 4 when the liquid feed reservoir 5 and the head block 4 are bonded to each other, as shown in FIG. 14.

Figure 15:
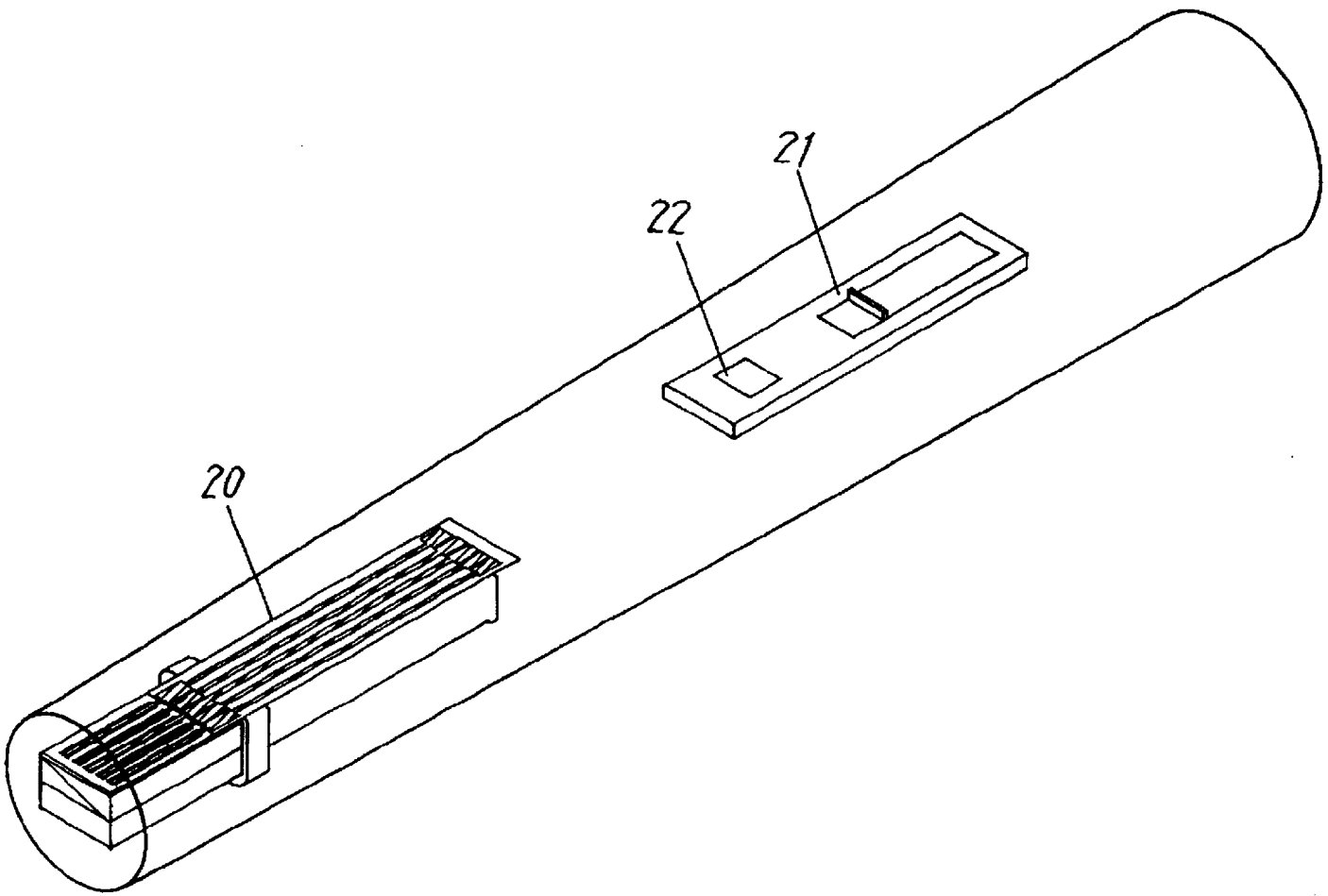
FIG. 15 is a perspective view of an ink-jet pen using the liquid injector according to Embodiment 1.

The finished liquid injector 20 may be mounted as an ink-jet spray to the tip of a pen, as shown in FIG. 15. The pen may include a knob 21 provided thereon for controlling the amount of the ink to be ejected. The ink-jet spray may be turned on by pressing a switch 22, and can spray an amount of the link determined with the knob 21. Three or more of the liquid injectors of this embodiment, upon being mounted in a pen, can eject corresponding color inks at once at different gradations to develop a desired color for printing. The ejected inks are sprayed out in a larger area. Since the gradations of the color inks are modified by movement of the pen, a resultant color may range infinitely. The spray can create a full color print. The color of print may not be anticipated by the operator, and then the spray may be used as a toy or an artistic painting tool.

Embodiment 2

Figure 16:
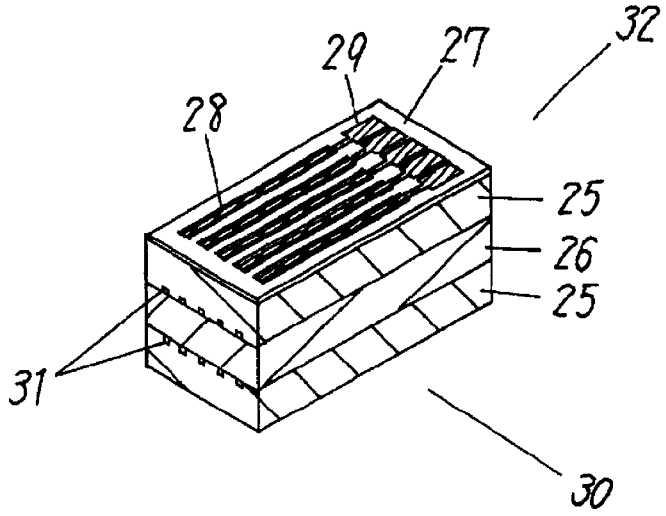
FIG. 16 is a perspective view of a head block as a primary part in a liquid injector according to Embodiment 2 of the present invention.

FIG. 16 is a perspective view of a head block of a liquid injector according to Embodiment 2 of the present invention.

As shown, a head block 30 includes a glass substrate 26, pressurizing-chamber-forming layers 25 of silicon single-crystal material on both sides of the glass substrate 26, and a pressurizing element 27 on one of the pressurizing-chamber-forming layers 25. The head block 30 is connected at the rear end to a liquid feed reservoir 5 (not shown) for supply of liquid. First lead-out electrodes 15 (not shown) provided on the head block 30 are connected to respective second lead-out electrodes 16 (not shown) provided on a flexible substrate 17 (not shown) (See FIG. 1).

Each pressurizing chamber extends between a liquid eject outlet 31 and a liquid feed inlet 32 (not shown). Similarly to Embodiment 1, the liquid feed reservoir 5, since being connected to the liquid feed inlets 32, can drive the liquid such as ink to flow to a liquid passage, i.e., the liquid feed inlets 32, the pressurizing chambers, and the liquid eject outlets 31. The liquid feed reservoir 5, upon having an opening greater than the cross section of the head block 30 at a side to the liquid feed inlet 32, can be bonded to the head block 30 easily. Plural pressurizing chamber forming layers 25, upon being bonded to both sides of the glass substrate 26 at the other side than the side to the pressurizing element 27, can increase liquid eject outlets 31 and liquid feed inlets 32 and locate them more closely to each other. This provides the liquid injector with more pressurizing chambers. When two, upper and lower, liquid eject outlets 31 and the liquid feed inlets 32 are vertically dislocated from each other about the glass substrate 26, the liquid injector can have the liquid eject outlets 31 positioned at high density.

A method of manufacturing the liquid injector according to Embodiment 2 will now be described.

Figure 17:
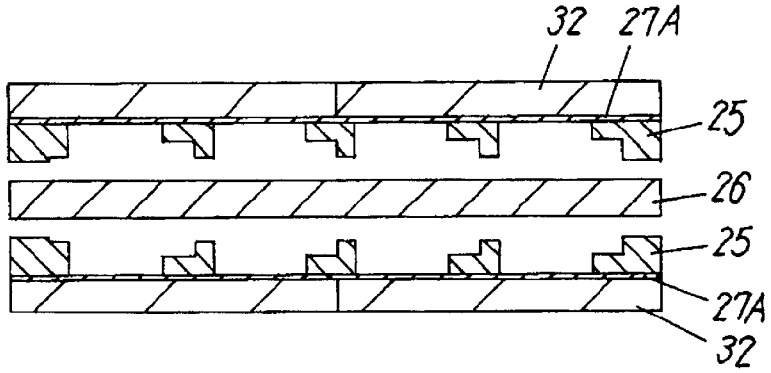
FIG. 17 is a cross sectional view illustrating a process of manufacturing the liquid injector according to Embodiment 2.

FIG. 17 to FIG. 20 illustrate a procedure of fabricating the head block of the liquid injector according to Embodiment 2. The steps prior to a step shown in FIG. 17 are identical to those of Embodiment 1 shown in FIG. 3 to FIG. 7.

Figure 18:
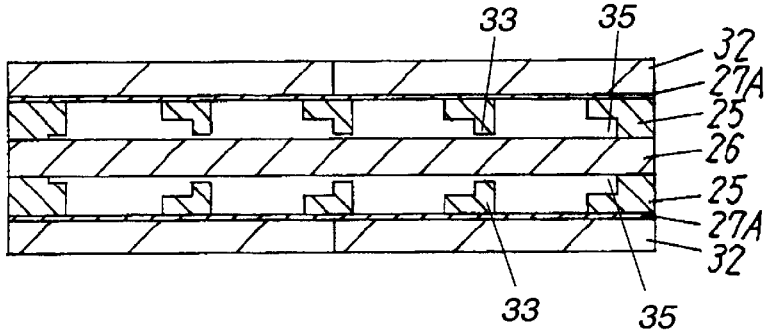
FIG. 18 is a cross sectional view illustrating a process of manufacturing the liquid injector according to Embodiment 2.

Assemblies including the respective pressurizing-chamber-forming layers 25 and pressure-element-forming layer base 32 are bonded directly to both respective sides of the glass substrate 26 at the other side than the side to the pressurizing element 27 to provide an assembly shown in FIG. 18. It may preferably be arranged to have two groups of the liquid eject outlets 31 and the liquid feed inlets 32 dislocated vertically from each other about the glass substrate 26. This permits the head block 30 to have more liquid eject outlets 31 and liquid feed inlets 32. Alternating the liquid eject outlets 31 and the liquid feed inlets 32 allows the head block 30 to be obtained easily.

Figure 19:
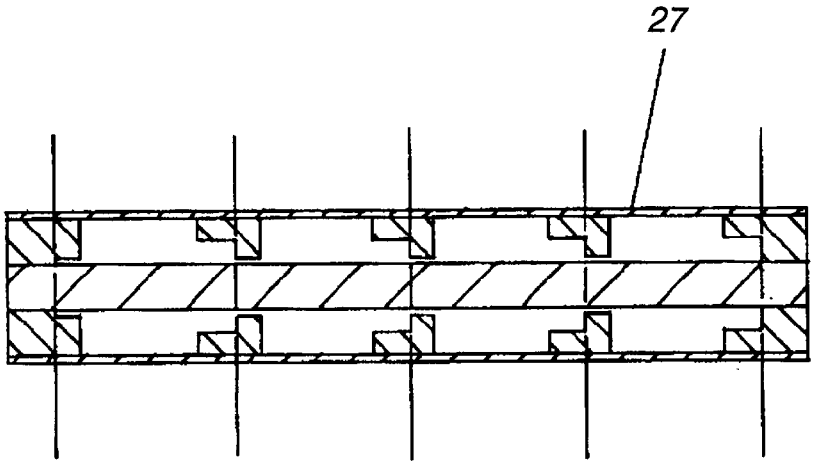
FIG. 19 is a cross sectional view illustrating a process of manufacturing the liquid injector according to Embodiment 2.

Then, after the pressurizing-chamber-forming layers 25 have been bonded directly to the glass substrate 26, the pressurizing-element-forming layers of magnesium oxide are immersed in solution such as phosphate and etched until the pressurizing element 27 is exposed as shown in FIG. 19. Then, a common photo etching process to develop a pattern of second electrodes 28 and piezoelectric strips 29 is performed.

Figure 20:
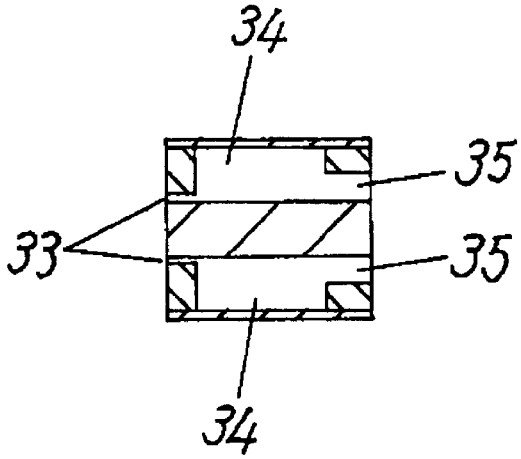
FIG. 20 is a cross sectional view illustrating a process of manufacturing the liquid injector according to Embodiment 2.

Then, as shown in FIG. 20, the element is divided along predetermined cutting lines into the head blocks 30. Thereby, the liquid eject outlets 31 and the liquid feed inlets 32 are formed by the final dividing process and can thus be aligned linearly being exposed to the outside.

The head block 30 is bonded to the liquid feed reservoir at the end to the liquid feed inlet 27, and then the liquid injector of Embodiment 2 is completed similarly to Embodiment 1.

What is claimed is:

1. A liquid injector comprising:

a head block including:

a first pressurizing-chamber-forming layer having a first pressurizing chamber formed therein for being filled with liquid, a first liquid eject outlet and a first liquid feed inlet through which the liquid is passed from the first pressurizing chamber; and a first actuator on said first pressurizing-chamber-forming layer for expanding and contracting an internal volume of the first pressurizing chamber, wherein the first pressurizing chamber, the first liquid eject outlet, and the first liquid feed inlet are linearly aligned.

2. A liquid injector according to claim 1, further comprising a liquid feed passage communicated to the first liquid feed inlet of said head block for feeding the liquid.

3. A liquid injector according to claim 2, further comprising:

a first electrode for driving said first actuator;

a liquid feed reservoir including said liquid feed passage;

a first pad on said liquid feed reservoir, said first pad being connected to said first electrode; and a first flexible electrode for connecting between said first electrode and said first pad.

4. A liquid injector according to claim 3, further comprising:

a plastic member on other side, of said liquid feed reservoir, than a side connected to said first electrode for bonding by heat or pressure, wherein the side, of said liquid feed reservoir, connected to said first electrode is arranged integral with the first flexible electrodes, and wherein said liquid feed reservoir is bonded to said first flexible electrode with said plastic member.

5. A liquid injector according to claim 4, wherein said liquid feed reservoir is made of elastic material.

6. A liquid injector according to claim 1, wherein said first pressurizing chamber forming layer is made of silicon material.

7. A liquid injector according to claim 1, wherein an opening of said liquid feed passage communicated to the first liquid feed inlet is larger than a side, of said head block, including the first liquid feed inlet.

8. A liquid injector according to claim 1, wherein said head block further includes:

a substrate on other side, of said first pressurizing-chamber-forming layer, than a side to said first actuator;

a second pressurizing-chamber-forming layer on other side, of said substrate, than a side on said the first pressurizing-chamber-forming layer, said second pressurizing-chamber-forming layer having a second pressurizing chamber formed therein filled with the liquid, a second liquid eject outlet and a second liquid feed inlet through which the liquid is passed from the second pressurizing chamber; and a second actuator on said second pressurizing-chamber-forming layer for expanding and contracting an internal volume of the second pressurizing chamber.

9. A liquid injector according to claim 8, wherein the first and second liquid eject outlets are located at different positions about said substrate.

10. A liquid injector according to claim 8, further comprising a liquid feed passage communicated to the first and second liquid feed inlet of said head block for feeding the liquid.

11. A liquid injector according to claim 10, further comprising:

a first electrode for driving said first actuator;

a second electrode for driving said second actuator;

a liquid feed reservoir including said liquid feed passage;

a first pad on said liquid feed reservoir, said first pad being connected to said first electrode;

a first flexible electrode for connecting between said first electrode and said first pad;

a second pad on said liquid feed reservoir, said second pad being connected to said second electrode; and a second flexible electrode for connecting between said second electrode and said second pad.

12. A liquid injector according to claim 11, further comprising:

a plastic member provided on other side, of said liquid feed reservoir, than respective sides connected to said first and second electrodes for bonding by heat or pressure, wherein the side, of said liquid feed reservoir, connected to said first electrode is arranged integral with said first flexible electrode, wherein the side, of the liquid feed reservoir, connected to said second electrode is arranged integral with said second flexible electrode, and wherein said liquid feed reservoir is bonded by said plastic member to said first and second flexible electrodes.

13. A liquid injector according to claim 12, wherein said liquid feed reservoir is made of elastic material.

14. A liquid injector according to claim 8, wherein said first pressurizing-chamber-forming layer is made of silicon material, and said substrate is made of glass material.

15. A liquid injector according to claim 8, wherein an opening of said liquid feed passage communicated to the first and second liquid feed inlets is larger than a side, of said head block, including the first and second liquid feed inlets.

16. A liquid jet spray comprising:

a case;

a liquid injector including a head block including:

a first pressurizing-chamber-forming layer having a first pressurizing chamber formed therein for being filled with liquid, a first liquid eject outlet and a first liquid feed inlet through which the liquid is passed from the first pressurizing chamber; and a first actuator on said first pressurizing-chamber-forming layer for expanding and contracting an internal volume of the first pressurizing chamber, the first pressurizing chamber, the first liquid eject outlet, and the first liquid feed inlet being linearly aligned; and means for determining an amount of the liquid ejected from said liquid injector, said means being disposed on said case.

17. A method of manufacturing a liquid injector, comprising the steps of:

bonding a pressurizing element to a first side of a pressurizing-chamber-forming layer with an adhesive layer;

forming a pressurizing chamber extending to the adhesive layer on a second side of the pressurizing chamber forming layer through etching the second side of the pressurizing chamber forming layer;

forming a liquid eject outlet and a liquid feed inlet aligned linearly with the pressurizing chamber; and disposing a substrate on the second side of the pressurizing chamber forming layer.

18. A method according to claim 17, wherein the pressurizing-chamber-forming layer is made of silicon single-crystal material, and wherein said step of forming the pressurizing chamber includes the sub-step of dry-etching the pressurizing-chamber-forming layer with etching gas containing fluorine.

19. A method according to claim 17, further comprising the step of:

unifying the pressurizing element with a pressurizing-element-forming layer at other side than a side to the pressurizing-chamber-forming layer.

20. A method according to claim 19, wherein the pressurizing-element-forming layer is made of magnesium oxide single-crystal material, said method further comprising the step of:

forming a heat radiating layer having a higher thermal conductivity than the magnesium oxide single-crystal material on other side, of the pressurizing element forming layer, than a side to the pressurizing-chamber-forming layer.

21. A method according to claim 20, wherein the heat radiating layer contains gold.

22. A method according to claim 21, further comprising the steps of removing the heat radiating layer with strong acid type water solution; and removing the pressurizing-element-forming layer with phosphate solution.

23. A method according to claim 22, further comprising the step of patterning the pressurizing element.

24. A method according to claim 23, further comprising the step of dividing the pressurizing-chamber-forming-layer, the pressurizing element, and the substrate by dicing, the liquid eject outlet and the liquid feed inlet are exposed.

25. A method of according to claim 24, further comprising the step of bonding an opening of a liquid feed reservoir to the exposed liquid feed inlet by thermal-pressure bonding.

26. A method according to claim 25, further comprising the steps of forming a flexible electrode on the liquid feed reservoir; and connecting the flexible electrode to an electrode pad connected to the pressurizing element simultaneously to said step of bonding the opening of the liquid feed reservoir.

27. A method according to claim 17, wherein the pressurizing-chamber-forming layer is made of silicon single-crystal material, said method further comprising the step of:

rinsing the pressurizing-chamber-forming layer being bonded to the pressurizing-element and having the pressurizing chamber formed therein with acid type rinsing agent.

28. A method according to claim 27, wherein the substrate is made of glass material, and wherein said step of disposing the substrate includes the sub-step of bonding the substrate directly to the second side of the pressurizing-chamber-forming layer rinsed with the acid type rinsing agent.

* * * * *